US006187148B1

(12) United States Patent
Sturgulewski

(10) Patent No.: US 6,187,148 B1
(45) Date of Patent: Feb. 13, 2001

(54) DOWNCOMER VALVE FOR NON-RECOVERY COKE OVEN

(75) Inventor: Raymond M. Sturgulewski, Pittsburgh, PA (US)

(73) Assignee: Pennsylvania Coke Technology, Inc., Greensburg, PA (US)

( * ) Notice: Under 35 U.S.C. 154(b), the term of this patent shall be extended for 0 days.

(21) Appl. No.: 09/259,198

(22) Filed: Mar. 1, 1999

(51) Int. Cl.[7] ..... C10B 27/06

(52) U.S. Cl. ..... 202/258; 256/270; 256/151; 137/625.47

(58) Field of Search ..... 202/256, 258, 202/270, 239, 151, 135; 251/205, 207, 209, 122, 310; 110/163; 137/625.41, 625.47

(56) References Cited

U.S. PATENT DOCUMENTS

| | | | | |
|---|---|---|---|---|
| Re. 32,197 | * | 7/1986 | Self | 251/127 |
| 1,060,837 | * | 5/1913 | Gohmann | 202/145 |
| 1,754,138 | * | 4/1930 | Agee | 251/205 |
| 2,159,359 | * | 5/1939 | Philipsen | 202/151 |
| 3,433,261 | * | 3/1969 | Fox | 251/209 |
| 3,815,871 | * | 6/1974 | Carlson | 251/310 |
| 3,957,590 | | 5/1976 | Rohde | 202/258 |
| 3,996,864 | * | 12/1976 | Jones | 110/163 |
| 4,314,888 | | 2/1982 | Corbman et al. | 202/143 |
| 4,599,140 | | 7/1986 | Bauer | 201/1 |
| 4,664,140 | | 5/1987 | Halbherr | 137/246 |
| 5,087,328 | | 2/1992 | Wegerer et al. | 201/2 |
| 5,114,542 | | 5/1992 | Childress et al. | 201/15 |
| 5,244,147 | * | 9/1993 | Furukawa | 110/163 |

* cited by examiner

*Primary Examiner*—Shrive Beck
*Assistant Examiner*—Susan Ohorodnik
(74) *Attorney, Agent, or Firm*—Armstrong, Westerman, Hattori, McLeland & Naughton

(57) ABSTRACT

The present invention is a valve for a non-recovery coke oven which permits improved control of the gas pressure in the interior cavity of the oven. The valve has a rotating plug with a beveled end which progressively connects and disconnects the interior cavity of an oven with a downcomer valve disposed in an oven wall to change the gas pressure in the interior of the oven. By controlling the gas pressure the amount of combustion air entering the oven can be controlled giving an operator control over the thermal gradients established by combustion. The combustion of a majority of the coal gas in the flues below the oven floor creates a thermal gradient that rises through the oven floor, a gradient which is ideal for the production of an improved coke product.

12 Claims, 5 Drawing Sheets

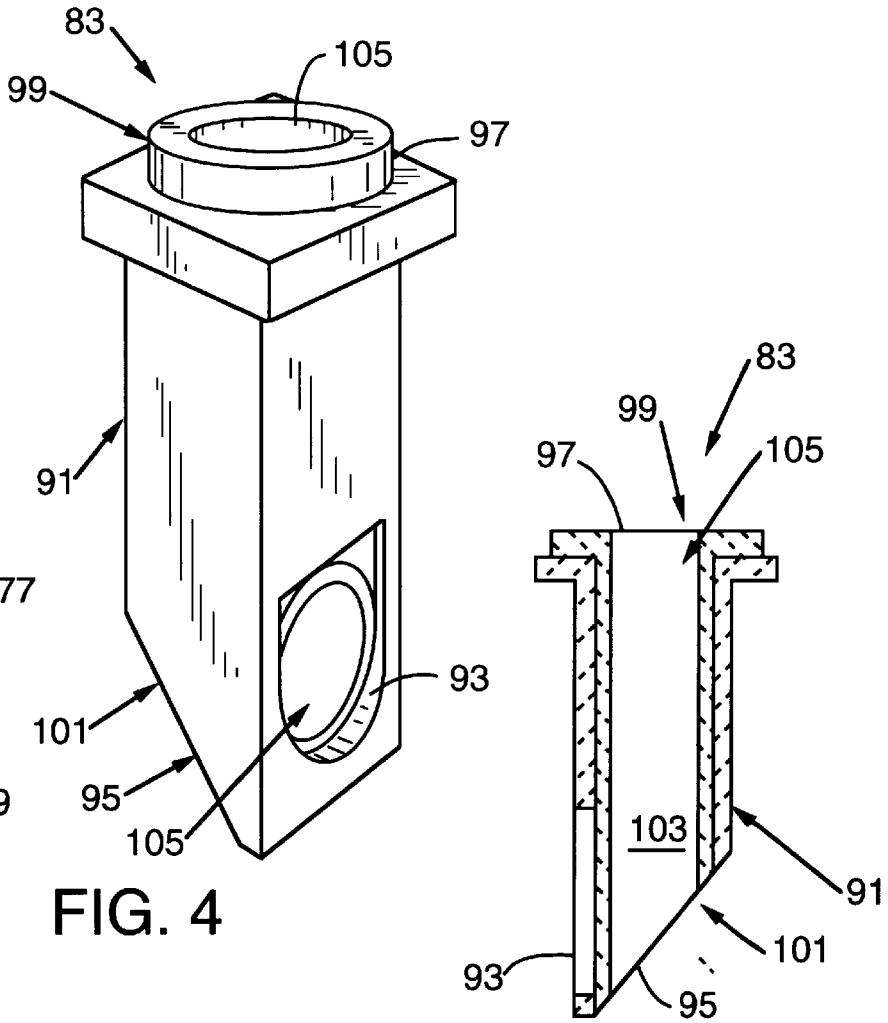
FIG. 5
FIG. 4
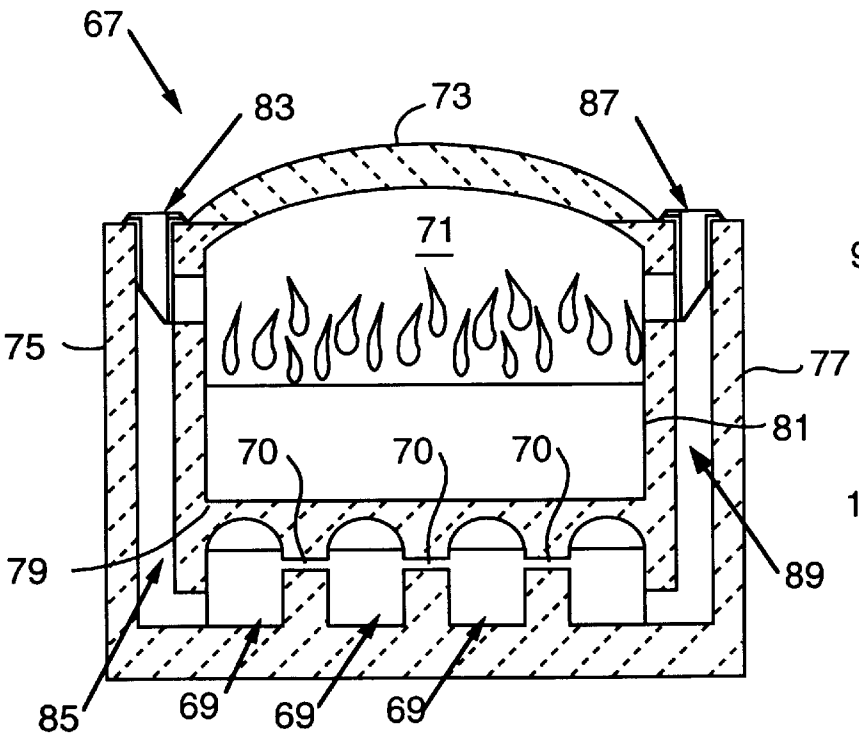
FIG. 3

DOWNCOMER VALVE FOR NON-RECOVERY COKE OVEN

FIELD OF THE INVENTION

The present invention relates to a valve in a non-recovery coke oven between the downcomer passage and the oven interior for the purpose of regulating pressure inside the oven.

BACKGROUND OF THE INVENTION

A non-recovery coke oven is used to convert coal into blast furnace grade coke by heating the coal in a reducing atmosphere and operating under negative pressure. The oven is heated by external means to 2500° F. The external heat is shut off and a bed of coal is charged to the floor of the oven. The surface of the coal bed immediately generates combustible gas, herein referred to as "coal gas," by the radiant energy absorbed by the oven roof from the external heat source. Approximately one-third (⅓) of the gas given off by the coal is selectively burned in a "primary" combustion by allowing "primary air" to be drawn into the oven interior through dampers in the doors of the oven. Next the combustion products and the remaining two-thirds (⅔) of the combustible gas are drawn through downcomers in the side walls of the oven into the sole flues, which are cavities below the oven floor for the combustion of gas. "Secondary air" is drawn into the sole flues to burn the remaining gases in a "secondary" combustion.

The heat generated by the primary combustion in the oven interior and the secondary combustion in the sole flues, provides the total heat to convert the coal into coke. Two independent thermal gradients occur, one beginning at the top of the coal bed and progressing downward and one beginning at the oven floor progressing upward. The proportion of primary and secondary air also controls the rate at which the thermal energy proceeds through the coal bed.

In the production of coke it is desirable to have a predominant secondary or "sole flue" coke thermal gradient beginning at the floor and progressing upward. The coke produced under this condition tends to be stronger and of high quality. The coke at the top of the bed resulting from the primary thermal gradient (called "bee-hive" coke) contains more air pockets and is somewhat spongy.

Controlling the amount of primary air in the oven interior is important. This is accomplished by manipulating air dampers in the oven doors. However, the volume of air that passes through a damper is not only a function of damper position, but also the negative pressure behind the damper which draws the air into the interior cavity of the oven. Oven interior pressure can be so different from outside pressure that even a damper position creating a small opening can overwhelm the cavity with primary air.

To solve the problem of pressure control, a valve in the downcomer passage or a "downcomer valve" acts as a variable restrictor which increases the pressure drop across the face of the downcomer. This permits a precise reduction of pressure in the interior of the oven which allows greater control of the inlet of primary combustion air.

OBJECTS OF THE INVENTION

It is the principal object of the invention to provide a valve in a non-recovery coke oven for the control and regulation of gas pressure in the interior of the oven.

It is an object of the present invention to provide a valve in a non-recovery coke oven that permits the precise reduction of gas pressure in the oven for improved control over inlet air.

It is another object of the present invention to provide a valve in a non-recovery coke oven downcomer between the oven and the sole flues which acts as a variable restrictor which increases the pressure drop across the face of the downcomer.

It is still another object of the present invention to provide a valve which improves the control over the operation of a non-recovery coke oven.

It is a yet another object of the present invention to provide an improved non-recovery coke oven which produces high quality coke.

It is a further object of the present invention to provide an improved method for operating a non-recovery coke oven.

Other objects, features and advantages of the present invention will become apparent from the following detailed description taken in conjunction with the accompanying drawings.

SUMMARY OF THE INVENTION

The present invention is a valve for connecting and disconnecting an interior of a non-recovery coke oven with an oven downcomer passage and oven sole flues. The valve has a housing having two passages, a first passage opening into the oven interior and a second passage opening into the downcomer passage. The second passage intersects the first passage at one end of the first passage which is opposite the oven interior. A rotatable cylindrical plug is disposed within the second passage and rotatable therein and has two ends, a first beveled end extending into an area of intersection between the first and second passages and a second end extending opposite the downcomer passage. Thus the non-recovery coke oven valve has a housing with two passages and a rotatable cylindrical plug disposable and rotatable within one of the passages of the housing.

Upon the rotation of the plug, the beveled end increases or decreases the intersecting area between the first and second passages creating an opening of variable size between the oven interior and the downcomer passage thereby controlling the pressure drop across the downcomer. This enables the change or reduction of pressure in the oven interior to permit enhanced control and regulation of the entrance of primary combustion air into the oven interior. The valve and method of operation allow for the control of the gas pressure within the interior of a non-recovery coke oven.

BRIEF DESCRIPTION OF THE DRAWINGS

FIG. 3 is a schematic view of a non-recovery coke oven having a downcomer valve of a second embodiment in each downcomer;

FIG. 4 is a perspective view of a downcomer valve of the second embodiment;

FIG. 5 is a cross-section view of the downcomer valve of FIG. 4;

DETAILED DESCRIPTION OF THE INVENTION

The present invention is a valve and a method of operating a valve for a non-recovery coke oven which permits improved control and regulation of the gas pressure in the interior of the oven. By controlling the gas pressure the amount of combustion air entering the oven can be controlled giving an operator control over the thermal gradients established by combustion of gases in the oven. The combustion of a majority of coal gas in the sole flues below the oven floor creates a thermal gradient that rises through the oven floor, a gradient which is ideal for the production of an improved coke product.

Figure 1:
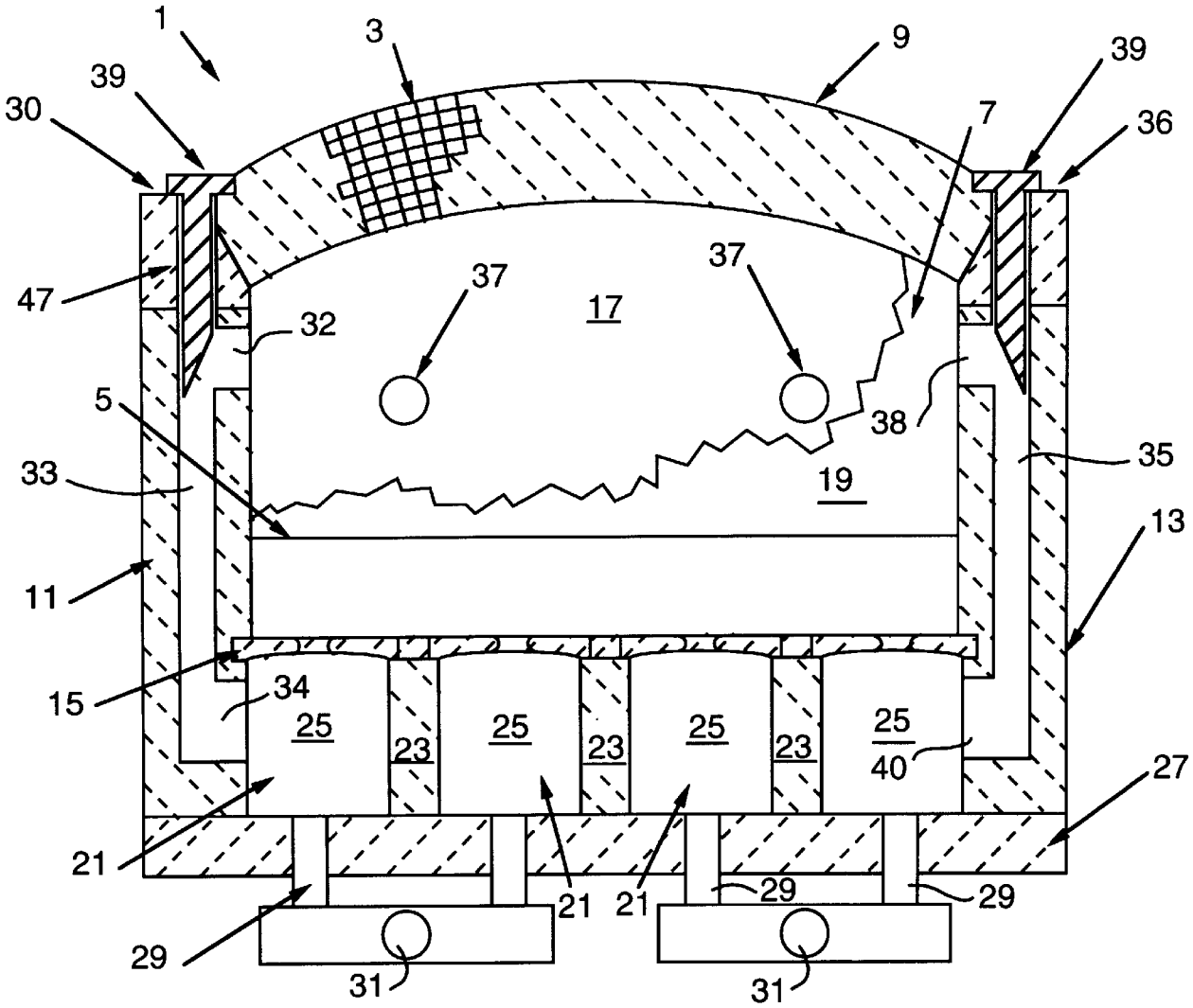
FIG. 1 is a schematic view of a non-recovery coke oven with a downcomer valve in each downcomer.

Referring to FIG. 1, a non-recovery coke oven 1 is a large refractory structure constructed typically of silica brick 3. The non-recovery coke oven 1 is used to convert a bed of coal 5 into blast furnace grade coke by heating the coal 5 in a reducing atmosphere and operating under negative pressure. The non-recovery coke oven 1 has a main interior cavity 7 which is formed by an arched roof 9, a first side wall 11, a second side wall 13, an oven floor 15, upon which lies coal 5 to be converted into coke, a front door 17 and a rear door 19. Coal 5 is charged through front door 17 at the front end of non-recovery coke oven 1 and the finished coke product is removed through the rear door 19 at the rear end.

Below oven floor 15 is a plurality of sole flues 21 which typically run the length of non-recovery coke oven 1 and are separated by brick walls 23 typically made of silica brick. Each sole flue 21 has an interior cavity 25, for the combustion of coal gas and air, which is formed by oven floor 15 at the top, a front wall and a rear wall (not shown) at the front and rear ends of non-recovery coke oven 1, a bottom wall, which is part of a larger sub-structure 27 and either two brick walls 23 or one brick wall 23 and one first side wall 11 or one second side wall 13. Sub-structure 27 forms the base of non-recovery coke oven 1. Sub-structure 27 is typically made of steel strong enough for supporting the entire non-recovery coke oven 1. Located within sub-structure 27 are a plurality of secondary air inlets 29 which communicate with sole flues 21. Each sole flue 21 may have a plurality of secondary air inlets 29 which are located along the length of each sole flue 21. Secondary air inlets 29 communicate with conduits 31 further associated with an air source (not shown) so that air can be injected directly into sole flues 21. Additionally, air inlets 29 provide the means by which the sole flues 21 which are closest to the center of non-recovery coke oven 1 communicate with the respective sole flues 21 which closest to the side walls of non-recovery coke oven 1.

Within first side wall 11 is located a downcomer 33 which is a passage for transporting gases from the interior cavity 7 of non-recovery coke oven 1 to sole flues 21. Downcomer 33, vertically disposed in side wall 11, extends from an opening 30 at the top of side wall 11 to a point proximate sub-structure 27, the point being adjacent to sole flue 21. Horizontally disposed in side wall 11 is passage 32, located proximate arched roof 9, connecting downcomer 33 with interior cavity 7 and passage 34 connecting downcomer 33 with sole flue 21. Opening 30 at the top of side wall 11 is suitable for receiving and mounting a downcomer valve 39 which extends vertically from opening 30 to passage 32. Downcomer valve 39 can be rotated to obstruct passage 32 to completely close or disconnect interior cavity 7 from downcomer 33.

A similar downcomer 35 is located in second side wall 13 and also communicates with interior cavity 7 and sole flues 21 of non-recovery coke oven 1 for transporting gases from the interior cavity 7 to sole flues 21. Downcomer 35, vertically disposed in side wall 13, extends from an opening 36 at the top of side wall 13 to a point proximate sub-structure 27, the point being adjacent to sole flue 21. Horizontally disposed in side wall 13 is passage 38, located proximate arched roof 9, connecting downcomer 35 with interior cavity 7 and passage 40 connecting downcomer 35 with sole flue 21. Opening 36 at the top of side wall 13 is suitable for receiving and mounting another downcomer valve 39 which extends vertically from opening 36 to passage 38. Non-recovery coke oven 1 has two downcomer valves 39 which are the same and operate in the same way.

The formation of high quality coke from coal in non-recovery coke oven 1 is as follows: Non-recovery coke oven 1 is heated by an external means (not shown) to approximately 2,500° F. The external heat is removed and a bed of coal 5 is charged to oven floor 15 through front door 17 of non-recovery coke oven 1. The surface of coal 5 immediately generates combustible gas, or coal gas, by the radiant energy absorbed from the external heat source by arched roof 9. Approximately one third (⅓) of the gas generated is selectively burned in the interior cavity 7 by allowing air to be drawn in through dampers 37 in front door 17 and dampers (not shown) in the rear door 19. Air that is drawn in through dampers 37 directly into the interior cavity 7 is called primary air.

The combustion products produced from the burning of the coal gas and the primary air and the remaining two thirds (⅔) of the coal gas are drawn through downcomers 33 and 35 into the plurality of sole flues 21, by opening downcomer valves 39 so that downcomers 33 and 35 communicate with interior cavity 7. Air is drawn into the plurality of sole flues 21 through the plurality of secondary air inlets 29 to burn the remaining combustible gases drawn down into sole flues 21 through downcomers 33 and 35. The air which is drawn directly into the plurality of sole flues 21 through secondary air inlets 29 is called secondary air.

The heat generated by the combustion of primary air and coal gas in the interior cavity 7 of non-recovery coke oven 1 and the heat generated by the combustion of coal gas and secondary air in the plurality of sole flues 21 provides the total heat necessary to convert the bed of coal 5 into coke. Two independent thermal gradients occur, one beginning at the top of bed of coal 5 progressing downward to oven floor 15 and the other beginning at oven floor 15 and progressing upward. The proportion of primary and secondary air, which affects the thermal gradients established, controls the rate at which thermal energy proceeds through the bed of coal 5 on oven floor 15.

It is desirable to have a predominant secondary or "sole flue" coke thermal gradient beginning at the oven floor 15 and progressing upward toward the arched roof 9 of non-recovery coke oven 1. Coal converted to coke under conditions with a strong secondary thermal gradient tends to be stronger and of higher quality. The coke at the top of the bed which is subject mainly to the primary thermal gradient (called the "bee-hive" coke) contains more air pockets and is spongy.

Controlling the amount of primary air in the interior cavity 7 of non-recovery coke oven 1 is important because it affects the quality and properties of the coke produced. Control of the primary air is accomplished by manipulating air dampers 37 on front door 17 and the air dampers (not shown) on the rear door 19. The problem that exists is that the volume of air that passes through the dampers 37 is not only a function of the position of individual damper 37, but also the negative pressure behind each damper 37 which draws air into the interior cavity 7. The pressure difference between the interior cavity 7 and the exterior of the oven can be so great that even a small opening of damper 37 can draw in more primary air than desired.

Downcomer valves 39, as shown in FIG. 1, are variable restrictors between interior cavity 7 and downcomers 33 and 35 and can be operated to reduce the pressure difference between interior cavity 7 and the exterior of the oven. More particularly, downcomer valves 39 can be operated to obtain a particular pressure inside interior cavity 7. They can be operated to reduce the negative pressure within interior cavity 7 so that any desired amount of primary air can be drawn in through dampers 37.

In the preferred embodiment shown in FIG. 1, downcomer valves 39 are disposed in the existing brick work of side walls 11 and 13. The brick work creates the vertical interior passages which are downcomers 33 and 35 as well as the horizontal passages connecting the downcomers 33 and 35 to interior cavity 7 and sole flues 21. Alternatively, downcomer valves 39 can be built as units or structures having a housing which has similar passages as those created in the brick work of side walls 11 and 13. A downcomer valve built with a housing, like that illustrated in FIGS. 4–6, can be installed into the side wall of a non-recovery coke oven so it functions like downcomer valve 39 in FIG. 1.

Figure 2:
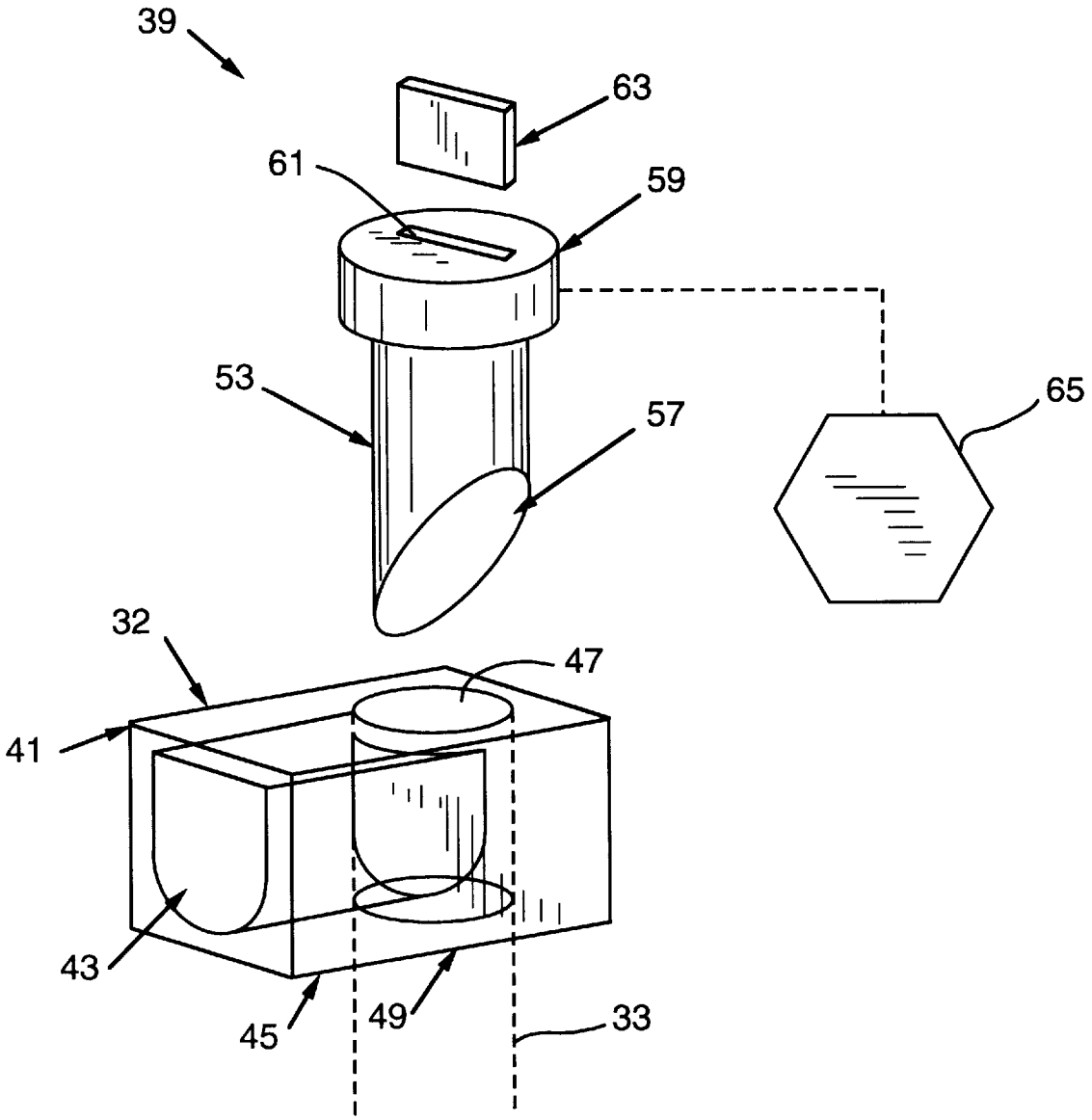
FIG. 2 is a perspective view of a downcomer valve of a first embodiment suitable for the oven of FIG. 1.

FIG. 2 illustrates a close up view of the preferred embodiment of downcomer valve 39 suitable for use in non-recovery coke oven 1 of FIG. 1. Because downcomer valve 39 is shown in FIG. 2 independent of non-recovery coke oven 1, a partial view of the brick work 41 of side wall 11 is also shown for purposes of illustration.

Downcomer valve 39 of FIG. 2, is associated with two passages: first passage 32 having an opening 43 at a first end 45 communicating with the interior cavity 7 of non-recovery coke oven 1, and second passage 47, which is the top portion of downcomer 33, from first passage 32 to opening 30, as shown in FIG. 1. In FIG. 2, second passage 47 is only partially illustrated. The top of second passage 47 opens at the top of side wall 11 at opening 30 (FIG. 1) which is not shown in FIG. 2. Second passage 47 intersects first passage 32 proximate a second end 49 of the first passage 32. Again second passage 47 has opening 30 shown in FIG. 1 for disposing and mounting downcomer valve 39.

Downcomer valve 39 includes a cylindrical plug 53 with a beveled end 57 and a flanged portion 59, of a larger diameter than cylindrical plug 53, attached to the end opposite the beveled end 57 of cylindrical plug 53. Associated with the intersection of the first passage 32 and the second passage 47 is the cylindrical plug 53 of downcomer valve 39 which is rotatable and disposable within the second passage 47. In this embodiment, the second passage 47 of downcomer 33 is the same cross-sectional area as downcomer 33 of FIG. 1. Although, in another embodiment, the cross-sectional area of passage 47 may be larger or smaller than that of downcomer 33.

The cylindrical plug 53 has a first, beveled end 57 extending into the second end 49 of the first passage 32. Upon the rotation of downcomer valve 39 the beveled end 57 cylindrical plug 53 increases or decreases the intersecting area between the first passage 32 and second passage 47 creating an opening of variable size between the oven interior cavity 7 and the downcomer 33 (and sole flues 21) thereby controlling the pressure drop across the downcomer 33. Downcomer valve 39 can be made of any castable material having good thermal shock resistance.

The beveled end 57 is preferably beveled at a 45° angle, but may be beveled in the range of about 30° to 60° and more preferably in the range of about 40° to 50°. Cylindrical plug 53 has flanged portion 59 opposite beveled end 57. Flanged portion 59 is suitable for receiving a means for rotating cylindrical plug 53. Flanged portion 59, as illustrated in FIG. 2, has a groove 61 for the insertion of a tool 63 for rotating downcomer valve 39.

Downcomer valve 39 is mounted in second passage 47 by inserting downcomer valve 39 into second passage 47 until flanged portion 59 contacts and rests on top of side wall 11. Because the diameter of flanged portion 59 is larger the diameter of opening 30 of second passage 47, downcomer valve 39 extends into downcomer 33 until the flanged portion 59 contacts the top of side wall 11. Cylindrical plug 53 extends down into second passage 47 until beveled end 57 is located in the intersection of passage 32 and 47. Downcomer valve 39 is of physical dimensions such that a good fit between the surface of cylindrical plug 53 and the surface of second passage 47 of downcomer 33 is created forming a seal that is relatively gas-tight and physically tight. Downcomer valve 39 is secured in downcomer 33 by gravity.

Downcomer valve 39 operates as follows: Upon the rotation downcomer valve 39 by tool 63, the beveled end 57 of cylindrical plug 53 increases or decreases an intersecting area between first passage 32 and second passage 47. The intersecting area can be increased or decreased progressively in an infinite number of increments. The increase or decrease of the intersecting area creates an opening of variable size between downcomer 33 and interior cavity 7 which enables the accurate control and regulation of gas pressure in the interior cavity 7 of non-recovery coke oven 1, illustrated in FIG. 1. The control of the pressure allows the control of the inlet of primary combustion air through dampers 37 of non-recovery coke oven 1.

For example, after coal 5 is charged to oven floor 15 the surface of the coal 5 generates coal gas. Even with the production of coal gas, the pressure in the interior cavity 7 is still negative because the operating temperature of approximately 2,500° F. and the initial operating pressure. The pressure is such that even a small opening of dampers 37 in the front door 17 would draw in too much primary air which would flood the interior cavity 7. In order to reduce the pressure difference between the interior cavity 7 and the outside of the non-recovery coke oven 1, downcomer valve 39, for example, is rotated from a shut or closed position, the position where the interior cavity 7 and downcomer 33 are not connected, to a position where a connection or opening exists between the interior cavity 7 and downcomer 33. This causes the flow of gas residing in downcomer 33 and sole flues 21 to enter into the interior cavity 7 which results in a reduction of the pressure difference or an increase in positive pressure in interior cavity 7. Downcomer valve 39 may be rotated back to the closed position when a desired reduction in pressure difference has occurred.

After the pressure difference as been reduced, dampers 37 are opened which allows the entrance of a controlled amount of primary air into interior cavity 7. The dampers 37 are regulated as primary air enters the interior cavity 7 and the coal gas is burned by the primary air. Downcomer valve 39 is then fully opened so that the intersecting area between the first passage 32 and the second passage 47 is optimum. Next the combustion products and the remaining two-thirds (⅔) of the combustible gas are drawn through downcomer 33 into the sole flues 21 where the remaining coal gas is burned. Since non-recovery coke oven 1 can have one downcomer valve 39 located in each downcomer 33 and 35, a first downcomer valve 39 in downcomer 33 may be rotated either simultaneously or independently of a second downcomer valve 39 in downcomer 35 to increase the rate of pressure change.

The tool 63 may be used to rotate downcomer valve 39 to connect and disconnect the interior cavity 7 with downcomer 33, as shown in FIG. 2. Again, the rotation of cylindrical plug 53 of downcomer valve 39 increases or decreases an intersecting area between the first passage 32 and the second passage 47 to control the pressure drop across the downcomer passage thereby enabling accurate reduction of a pressure difference in the interior cavity of a non-recovery coke oven so the inlet of primary air may be better controlled.

Furthermore, downcomer valve 39 can be optionally operated by a PLC (process logic controller) device 65 as represented by the dashed lines. A pressure sensor (not shown) also connected to the PLC device 65 may be added to the interior cavity 7 of non-recovery coke oven 1 so the downcomer valve 39 may be controlled based on information about gas pressure obtained from the pressure sensor in the interior cavity 7. Often, however, downcomer valve 39 is controlled manually at the top of side wall 11, in FIG. 1, by the use of a tool for rotating downcomer valve 39.

FIG. 3 illustrates a non-recovery coke oven 67 similar to non-recovery coke oven 1 of FIG. 1. An interior cavity 71 formed by an arched roof 73, a first side wall 75, a second side wall 77, an oven floor 79, upon which is charged a bed of coal 81, and front and rear doors (not shown). Underneath oven floor 79 are a plurality of sole flues 69 connected by internal passages 70.

Non-recovery coke oven 67 has a first downcomer valve 83 in a first downcomer passage 85 and a second downcomer valve 87 in a second downcomer passage 89. Downcomer valves 83 and 87 are variable restrictors and can be operated to increase or decrease the pressure drop across the face of downcomers 85 and 89. Downcomer valves 85 and 89 permit a precise control and regulation of the pressure inside the interior cavity 71 of non-recovery coke oven 67 shown in FIG. 3. This allows for greater control of the inlet of primary combustion air which allows for greater control over the thermal gradients created inside non-recovery coke oven 67.

First downcomer valve 83, for example, connects and disconnects the interior cavity 71 of non-recovery coke oven 67 with downcomer 85. First downcomer valve 83 is built into first side wall 75. First downcomer valve 83 of FIGS. 4 and 5 has a housing 91 having a plurality of openings, a first opening 93 communicating with the interior cavity 71 of non-recovery coke oven 67; a second opening 95, communicating with the first opening 93 by an intersecting area and communicating with the downcomer 85; and a third opening 97 for the insertion of a cylindrical plug 99 disposable and rotatable within the housing 91 located in downcomer 85. First downcomer valve 83 has housing 91 which is a single housing with a plurality of openings. The cylindrical plug 99 has a first, beveled end 101 extending into the intersecting area 103 of first opening 93 and second opening 95.

First downcomer valve 83 of FIGS. 4 and 5 is shown with an orifice 105 in cylindrical plug 99. Housing 91 is in a contacting relationship with first downcomer passage 85 of first side wall 75. Housing 91 is secured into first downcomer passage 85 so first downcomer valve 83 will have a secure fit in first downcomer passage 85.

Orifice 105 is for the purpose of letting air into first downcomer passage 85 to burn coal gas in either the interior cavity 71 or sole flues 69. When cylindrical plug 99 is positioned in the shut or closed position, the position disconnecting the interior cavity 71 from first downcomer passage 85 (FIG. 6) air enters into downcomer valve 85 and travels to sole flues 69. In this embodiment, secondary combustion air is drawn into sole flues 69 through the orifice 105 in cylindrical plug 99 of first downcomer valve 83. First, downcomer valve 83 with an orifice 105 in the cylindrical plug 99 may also be used in conjunction with secondary air inlets in the plurality of sole flues. It is a design option for flexibility in air flow.

Figure 6:
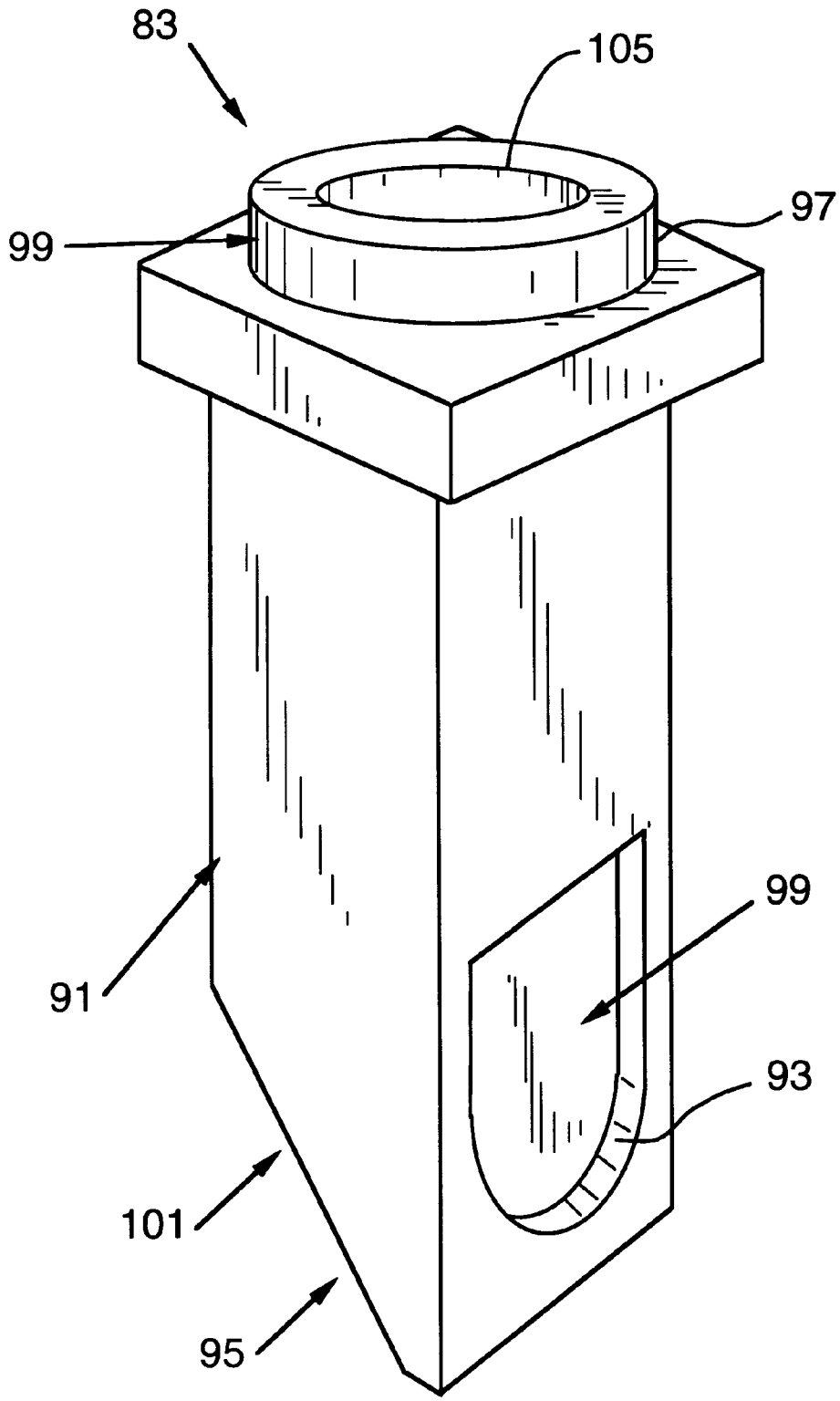
FIG. 6 is a perspective view of a downcomer valve of the second embodiment showing the plug rotated in the closed position.

FIG. 6 is a perspective view of downcomer valve 83 of the second embodiment showing cylindrical plug 99 rotated in the closed or shut position, indicated by the diagonal lines at the base of cylindrical plug 99 viewed through first opening 93. In the closed position, orifice 105 and second opening 95 are blocked by cylindrical plug 99 from communicating with first opening 93 and interior cavity 71 of non-recovery coke oven 67.

The above description for first downcomer valve 83 is applicable to second downcomer valve 87. Further first downcomer valve 83 functions in the same was as downcomer valve 39 of FIG. 2, except for the operational feature of allowing the inlet of secondary combustion air through orifice 105. The first downcomer valve 83 of FIGS. 4 and 5 may also be controlled by a PLC device (not shown).

Figure 7:
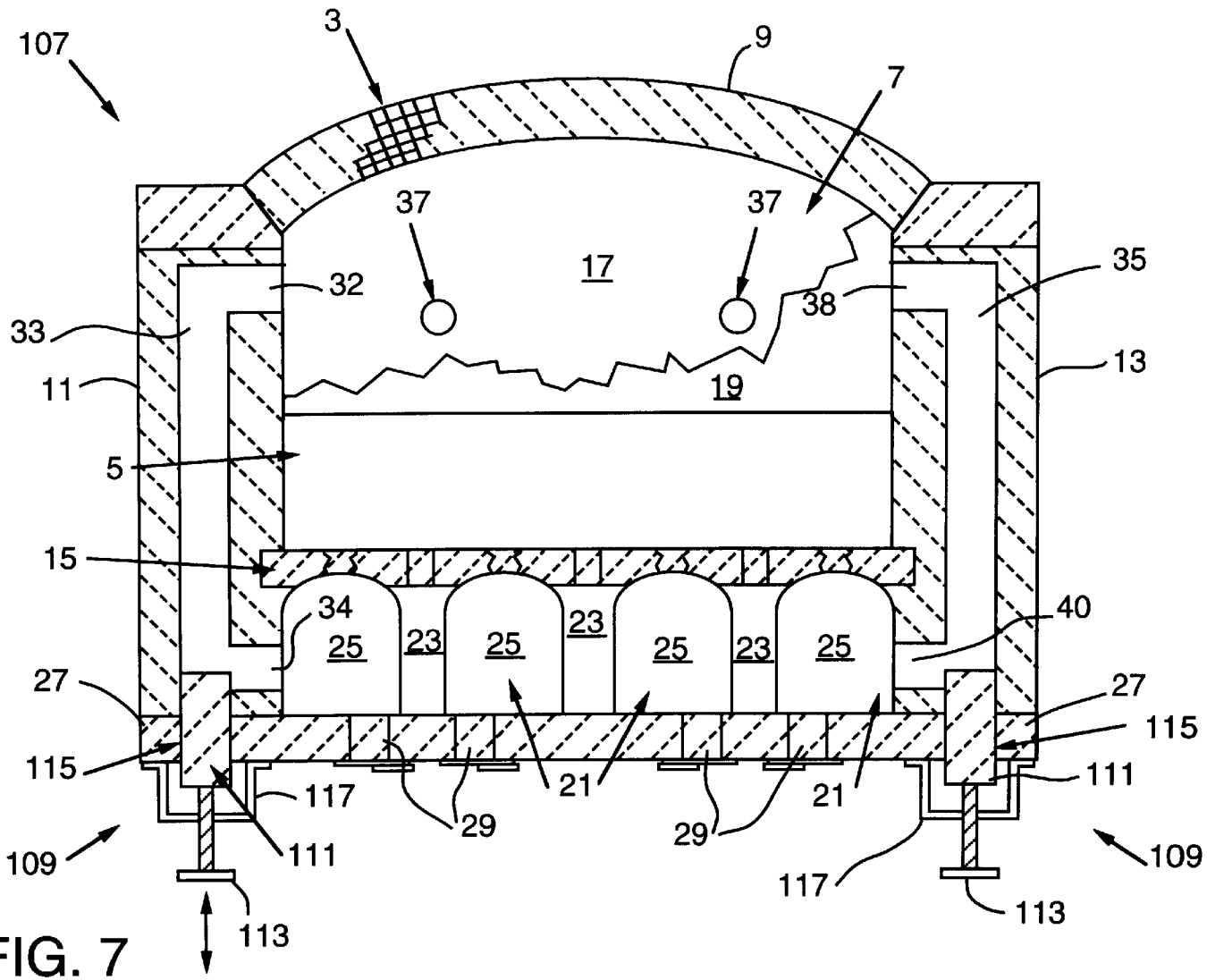
FIG. 7 is a schematic view of a non-recovery coke oven with a downcomer valve of a third embodiment in each downcomer.

FIG. 7 illustrates a non-recovery coke oven 107 similar to the non-recovery coke oven 1 of FIG. 1. The reference numbers of FIG. 7 that are the same as the reference numbers of FIG. 1 correspond to like parts. The main difference of non-recovery coke oven 107 is the location and shape of the downcomer valves 109 disposed in downcomers 33 and 35.

Downcomer valve 109 includes a rectangular plug 111 attached to an extension arm 113 for actuating the rectangular plug 111. Downcomer valve 109, located at the bottom of downcomer 33, is disposed and mounted in sub-structure 27 at the bottom of non-recover coke oven 107. Downcomer valve 109 extends from an opening 115 in the base of sub-structure 27 into downcomer 33. A protective housing 117 is constructed around opening 115 where rectangular plug 115 extends through sub-structure 27.

Downcomer valves 109, as shown in FIG. 7, are variable restrictors between interior cavity 7 and downcomers 33 and 35 and can be operated to obtain a particular pressure with in interior cavity 7. They can be operated to reduce the negative pressure within interior cavity 7 so that any desired amount of primary air can be drawn in through dampers 37.

In downcomer 33 in the embodiment of FIG. 7, downcomer valve 109 is actuated up and down (in the direction of the arrow below extension arm 113), either manually or automatically by an actuating means connected to extension arm 113, to open and close passage 34 between downcomer 33 and sole flue 21. By connecting and disconnecting downcomer 33 and interior cavity 7 to the sole flues 21 the pressure in interior cavity 7 can be regulated.

In FIG. 7, downcomer valve 109 slides up and down in downcomer 33 as opposed to downcomer valve 39 in FIG. 1 which is rotated in downcomer 33.

While there has been illustrated and described several embodiments of the present invention, it will be apparent that various changes and modifications thereof will occur to those skilled in the art. It is intended in the appended claims to cover all such changes and modifications that fall within the true spirit and scope of the present invention.

What is claimed is:

1. A valve disposed in a downcomer connecting an interior cavity of a non-recovery coke oven with sole flues below the interior cavity comprising:

a housing with a plurality of openings;

at least one first opening in said housing communicating with said interior cavity of a non-recovery coke oven;

at least one second opening in said housing communicating with said first opening and said downcomer;

at least one third opening in said housing for accepting a valve plug; and said hollow valve plug having a first end and a second end and an orifice extending there between, said hollow valve plug disposed in said at least one third opening and the first end extending into an intersecting area between said at least one first opening and said at least one second opening whereby moving said valve plug increases or decreases an intersecting volume thereby connecting or disconnecting said interior cavity and said downcomer to control and regulate the gas pressure in the interior cavity of said non-recovery coke oven, and whereby secondary combustion air can be drawn through the orifice to the sole flues wherein said valve plug is cylindrical and has the first end which is beveled and said first end is associated with said intersecting area of said at least one first opening and said at least one second opening and said valve plug has the second end for accepting a means for rotating said valve plug, whereby said valve plug can be rotated thereby increasing or decreasing an intersecting volume thus controlling the pressure drop across said downcomer.

2. The valve according to claim 1, wherein said first, beveled end of said cylindrical plug is beveled at an angle in a range of 30° to 60°.

3. The valve according to claim 1, wherein said first, beveled end of said cylindrical plug is beveled at a 45° angle.

4. The valve according to claim 1, wherein said valve plug is controlled by a PLC device.

5. The valve according to claim 1, wherein said valve is built into a side wall of said non-recovery coke oven, such that it is part of the brick work.

6. The valve according to claim 1, wherein said valve is independent from and disposed in a side wall of said non-recovery coke oven.

7. In combination, a valve disposed in a downcomer and a non-recovery coke oven with the downcomer, the combination comprising:

a non-recovery coke oven having an interior cavity, sole flues below the interior cavity and the downcomer connecting the interior cavity and the sole flues, the downcomer having the valve disposed therein;

a housing for the valve with a plurality of openings;

at least one first opening in said housing communicating with said interior cavity of a non-recovery coke oven;

at least one second opening in said housing communicating with said first opening and said downcomer;

at least one third opening in said housing for accepting a valve plug; and said hollow valve plug having a first end and a second end and an orifice extending there between, said hollow valve plug disposed in said at least one third opening and the first end extending into an intersecting area between said at least one first opening and said at least one second opening whereby moving said valve plug increases or decreases an intersecting volume thereby connecting or disconnecting said interior cavity and said downcomer to control and regulate the gas pressure in the interior cavity of said non-recovery coke oven, and whereby secondary combustion air can be drawn through the orifice to the sole flues wherein said valve plug is cylindrical and has the first end which is beveled and said first end is associated with said intersecting area of said at least one first opening and said at least one second opening and said valve plug has the second end for accepting a means for rotating said valve plug, whereby said valve plug can be rotated thereby increasing or decreasing an intersecting volume thus controlling the pressure drop across said downcomer.

8. The combination according to claim 7, wherein said first, beveled end of said cylindrical plug is beveled at an angle in a range of 30° to 60°.

9. The combination according to claim 7, wherein said first, beveled end of said cylindrical plug is beveled at a 45° angle.

10. The combination according to claim 7, wherein said valve plug is controlled by a PLC device.

11. The combination according to claim 7, wherein said valve is built into a side wall of said non-recovery coke oven, such that it is part of the brick work.

12. The combination according to claim 7, wherein said valve is independent from and disposed in a side wall of said non-recovery coke oven.

* * * * *